US006063303A

United States Patent [19]

Ohtaki

[11] Patent Number: 6,063,303

[45] Date of Patent: May 16, 2000

[54] MAGNETIC POWDER AND MAGNETIC MOLDED ARTICLE

[75] Inventor: Hitoshi Ohtaki, Sakata, Japan

[73] Assignee: TDK Corporation, Tokyo, Japan

[21] Appl. No.: 09/147,704

[22] PCT Filed: Aug. 21, 1997

[86] PCT No.: PCT/JP97/02908

§ 371 Date: Feb. 22, 1999

§ 102(e) Date: Feb. 22, 1999

[87] PCT Pub. No.: WO98/08233

PCT Pub. Date: Feb. 26, 1998

[30] Foreign Application Priority Data

Aug. 21, 1996 [JP] Japan ..... 8-219765

[51] Int. Cl.[7] ..... H01F 1/26; H01F 1/113; H01F 1/08

[52] U.S. Cl. ..... 252/62.54; 252/62.53; 252/62.55; 106/460; 148/104; 148/105; 524/440; 524/435; 523/137; 523/447; 523/458; 523/512; 523/513; 523/515

[58] Field of Search ..... 428/407; 148/104, 148/105; 524/440, 435; 523/137, 447, 458, 512, 513, 515; 252/62.53, 62.54, 62.55; 106/460

[56] References Cited

U.S. PATENT DOCUMENTS

| | | | |
|---|---|---|---|
| 3,573,979 | 4/1971 | Honjo | 252/62.54 |
| 3,916,038 | 10/1975 | Yamaguchi et al. | 252/62.54 |
| 4,320,080 | 3/1982 | Esper et al. | 252/62.54 |
| 4,431,979 | 2/1984 | Stijntjes et al. | 252/62.54 |
| 4,474,676 | 10/1984 | Ishino et al. | 252/62.53 |
| 4,501,795 | 2/1985 | Takeuchi et al. | 428/407 |
| 4,624,812 | 11/1986 | Farrow et al. . | |
| 4,824,587 | 4/1989 | Kwon et al. | 252/62.53 |
| 4,879,055 | 11/1989 | Sezaki et al. | 252/62.54 |
| 6,001,272 | 12/1999 | Ikuma et al. | 252/62.54 |

FOREIGN PATENT DOCUMENTS

| | | | |
|---|---|---|---|
| 302355 | 2/1989 | European Pat. Off. | 148/105 |
| 2-153003 | 6/1990 | Japan . | |
| 2-185540 | 7/1990 | Japan . | |
| 2-226799 | 9/1990 | Japan . | |
| 3-96202 | 4/1991 | Japan . | |
| 4-12029 | 1/1992 | Japan . | |
| 5-304019 | 11/1993 | Japan . | |
| 6-84648 | 3/1994 | Japan . | |
| 6-163236 | 6/1994 | Japan . | |
| 6-204027 | 7/1994 | Japan . | |
| 6-215919 | 8/1994 | Japan . | |
| 6-251928 | 9/1994 | Japan . | |
| 6-260319 | 9/1994 | Japan . | |
| 6-275419 | 9/1994 | Japan . | |
| 7-153616 | 6/1995 | Japan . | |

*Primary Examiner*—C. Melissa Koslow

*Attorney, Agent, or Firm*—Oblon, Spivak, McClelland, Maier & Neustadt, P.C.

[57] ABSTRACT

The present invention relates to a magnetic powder that contains resin-coated magnetic particles. The resin-coated magnetic particles include magnetic particles A and B that are formed in non-spherical shapes, with the magnetic particles A and B coated with a resin C. The resin-coated magnetic particles make it possible to increase the filling quantity of the magnetic particles A and B when the magnetic powder is employed to constitute a magnetic molded article, to ultimately improve the electromagnetic characteristics of the magnetic molded article.

22 Claims, 1 Drawing Sheet

MAGNETIC POWDER AND MAGNETIC MOLDED ARTICLE

TECHNICAL FIELD

The present invention relates to a magnetic powder and a magnetic molded article constituted by molding the magnetic powder.

BACKGROUND ART

A resin containing magnetic material that achieves its electromagnetic characteristics by dispersing magnetic powder in a resin is used to constitute the mold core material employed in electronic parts in which specific electromagnetic characteristics are required, such as choke coils, inductors, rotary transformers, EMI elements and the like in the known art. Magnetic particles constituting such a magnetic powder are formed in an almost spherical shape to assure a sufficient degree of fluidity during injection molding.

The resin containing magnetic material described above achieves outstanding advantages such as superior dimensional accuracy and a greater degree of freedom afforded in shape since it is achieved without undergoing a sintering process, compared to magnetic oxide materials that are achieved as sintered bodies through molding and sintering. However, the electromagnetic characteristics achieved in a magnetic molded article constituted of a resin containing magnetic material obtained through the prior art technology are inferior.

For instance, if a ferrite resin achieving good injection moldability and a high degree of magnetic permeability, which is obtained by selecting an appropriate particle size distribution and an appropriate content of the ferrite powder in the ferrite resin as disclosed in Japanese Unexamined Patent Publication No. 163236/1994, is employed to constitute a magnetic molded article, a low initial magnetic permeability $\mu i$ of approximately 22 is achieved.

In Japanese Unexamined Patent Publication No. 204027/1994, an approach in which a heat treatment is implemented at varying temperatures for different particle sizes of magnetic particles mixed in a magnetic oxide material, is disclosed. However, the resulting magnetic molded article only achieves an initial magnetic permeability $\mu i$ of approximately 35 at best.

While other prior art technologies such as those disclosed in Japanese Unexamined Patent Publication No. 185540/1990, Japanese Unexamined Patent Publication No. 226799/1990, Japanese Unexamined Patent Publication No. 96202/1991, Japanese Unexamined Patent Publication No. 12029/1992, Japanese Examined Patent Publication No. 52422/1991, Japanese Unexamined Patent Publication No. 84648/1994 and the like are known, a sufficient initial magnetic permeability cannot be achieved in any of the resulting magnetic molded articles, since the dimensions of the particles mixed in the magnetic oxide material are too small, the ratio at which they are mixed is too low.

DISCLOSURE OF THE INVENTION

It is an object of the present invention to provide a magnetic powder and a magnetic molded article constituted by molding the magnetic powder, with which the quantity of the magnetic particles filled in a magnetic molded article can be increased, to improve the electromagnetic characteristics.

In order to achieve the object described above, the magnetic powder according to the present invention is constituted of an aggregation of resin-coated magnetic particles. The resin-coated magnetic particles include non-spherical magnetic particles which are coated with resin. According to the present invention, the term "non-spherical" covers a large variety of shapes including scale shapes, flat shapes, shapes with a portion of a sphere or ovoid missing, and shapes with indentations and projections formed on the surface.

In order to improve the electromagnetic characteristics in a resulting magnetic molded article, the weight (filling quantity) of the magnetic powder relative to the entire volume must be increased as much as possible. However, in the prior art, it has been recommended that spherical or nearly spherical magnetic particles be used in consideration of achieving a sufficient degree of fluidity of the resin when dispersing the particles in the resin and, in particular, when performing injection molding.

As explained earlier, with the spherical magnetic particles in the prior art, the initial magnetic permeability that is achieved in a resulting magnetic molded article is approximately 35 at best, and it is difficult to assure an initial magnetic permeability higher than this. The reason for this is deduced to be that in the prior art, with almost spherical magnetic particles employed, point contact occurs among the spherical magnetic particles on their spherical surfaces in a magnetic molded article, increasing the gaps between the individual magnetic particles and therefore limiting the degree to which the filling quantity of the magnetic particles can be increased.

The inventor of the present invention has conducted extensive research to address the problem of the prior art discussed above, and has discovered that by using non-spherical magnetic particles, it becomes possible to increase the filling quantity of the magnetic particles in a magnetic molded article due to reduced gaps between individual magnetic particles, to improve the electromagnetic characteristics.

In addition, since the surface area per non-spherical magnetic particle is larger than that of an almost spherical particle, the force with which it adheres to the resin increases, and thus, there is another advantage that we may expect in that the bonding strength between the magnetic particles and the resin increases.

It is desirable that the magnetic particles be constituted of a plurality of types of particles having different particle diameters, all of which are commonly coated with resin. In this case, as long as at least one of the plurality of types of magnetic particles is non-spherical, the other types of magnetic particles may be either spherical or non-spherical. In other words, combinations in which all the magnetic particles are spherical must be excluded. The particle diameter of a magnetic particle may be defined as the maximum diameter of the particle.

If, among the resin-coated magnetic particles, those particles having large particle diameters are formed in a non-spherical shape, the gaps formed between the magnetic particles with the large particle diameters can be filled with magnetic particles having small particle diameters that are formed in spherical or non-spherical shapes. Thus, when a magnetic molded article constituted of such resin-coated magnetic particles is formed, the weight of the magnetic particles relative to the entire volume of the resin-coated magnetic particles can be further increased, thereby making it possible to assure even better electromagnetic characteristics.

If magnetic particles with a large particle diameter are formed in a spherical shape, too, the area surrounding these magnetic particles will be filled by magnetic particles with small particle diameters formed in non-spherical shapes, thereby further increasing the weight of the magnetic particles relative to the entire volume of the resin-coated magnetic particles in a magnetic molded article, to assure further improvement in the electromagnetic characteristics.

In addition, since a degradation in the electromagnetic characteristics occurs when the resin present between the magnetic particles presents magnetic resistance, it is desirable that the particle diameters of the magnetic particles be as large as possible. In the preferred mode described above, since the gaps formed between the magnetic particles with large particle diameters are filled by magnetic particles having smaller particle diameters, the magnetic resistance presented by the resin between the magnetic particles is reduced. Thus, the electromagnetic characteristics are further improved.

Through a synergy of the advantages described above, with the magnetic powder according to the present invention, a magnetic molded article that achieves an improved initial magnetic permeability of 40 or more compared to the initial magnetic permeability in the 30's in the prior art is obtained.

In addition, since the resin-coated magnetic particles contained in the magnetic powder according to the present invention are constituted by coating magnetic particles with resin, an improvement in the fluidity is achieved to enable injection molding.

A number of different methods may be employed to form the resin coating film, including vapor phase methods such as gassification, liquid phase methods such as various composite methods implemented in a solvent and solid phase methods such as the method in which a resin layer is formed through a mechano-chemical effect while agitating a mixture containing a resin and the method in which a portion of the resin is caused to adhere through impact with the resin.

Either a thermosetting resin or a thermoplastic resin may be employed in the present invention, as long as no stress occurs in the magnetic powder due to expansion associated with its softening and hardening.

The magnetic powder according to the present invention does not impose any restrictions whatsoever on various types of surface treatments on the magnetic powder that are implemented as a regular practice or the addition of various additives that may be employed to improve various characteristics.

The magnetic powder according to the present invention is employed to mold a magnetic molded article. Examples of such magnetic molded articles include the cores of choke coils, inductors, rotary transformers, EMI elements or the like.

Since a resin coating film is formed on the surfaces of non-spherical magnetic particles in the magnetic powder according to the present invention, a magnetic molded article containing a great quantity of magnetic particles can be achieved by filling the magnetic powder into a metal mold and applying heat and pressure to cause the resin to melt and harden. The molding itself is implemented by filling the magnetic powder in a mold that can be heated to the temperature at which the coated resin becomes soft or to the temperature at which the softening starts and applying heat and pressure.

In order to achieve high density filling at this point, it is effective to apply vibration. After the application of heat and pressure, the molded article is cooled and then taken out. However, depending upon the type of resin used, it is sometimes desirable not to apply pressure, since if pressure is applied, the magnetic powder becomes subject to stress during the cooling, resulting in a degradation in the electromagnetic characteristics. Depending upon the required characteristics and the required form, the molded article may be taken out without performing heat application during pressurized molding and then be heated in an oven to harden the resin.

With a magnetic molded article constituted by molding the magnetic powder according to the present invention, good electromagnetic characteristic values and, in particular, an initial magnetic permeability, $\mu i$ of 40 or more, can be achieved. These are the characteristics that are the minimum requirements that must be achieved in the cores in parts such as choke coils, inductors and EMI elements whose cores have been constituted of sintered bodies in the prior art. Thus, the magnetic powder according to the present invention can be used as a high accuracy material for constituting various cores that demonstrate superior dimensional accuracy compared to sintered cores while achieving characteristics comparable to those achieved with sintered cores. The magnetic molded article according to the present invention may be used by itself or it may be used in combination with other molded articles constituted of sintered magnetic material, a magnetic oxide material, a metallic magnetic material, a non-magnetic material or the like.

BRIEF DESCRIPTION OF THE DRAWINGS

Other objects, structural features and advantages of the present invention are explained in further detail in reference to the attached drawings illustrating preferred embodiments.

BEST MODE FOR CARRYING OUT THE INVENTION

Figure 1:
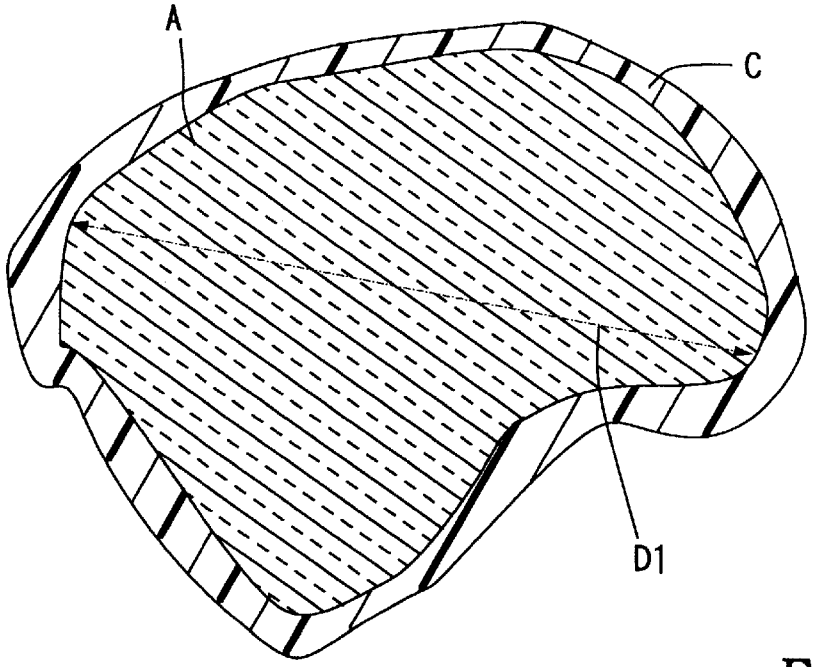
FIG. 1 is an enlarged cross section of a resin-coated magnetic particle contained in the magnetic powder according to the present invention.

In FIG. 1, a resin-coated magnetic particle includes a non-spherical magnetic particle A which is thinly coated with resin C. The magnetic powder according to the present invention is an aggregation of the magnetic particles A, one of which is shown in FIG. 1. The non-spherical magnetic particles A may be obtained in the form of pulverized ferrite pieces. The maximum value for the particle diameter D1 of the magnetic particles A is determined in correspondence to the thickness of the magnetic molded article. For instance, if the minimum thickness of the magnetic molded article is 5000 $\mu$m, the maximum particle diameter D1 of the magnetic particles A is 5000 $\mu$m.

When a magnetic molded article is formed by magnetic powder that contains a great number of non-spherical magnetic particles A as shown in FIG. 1, a phenomenon in which a projecting portion of another magnetic particle A fits in an indented portion of a magnetic particle A occurs, thereby reducing the gaps between the magnetic particles. Thus, the filling quantity of the magnetic particles A can be increased to improve the electromagnetic characteristics.

In addition, since the surface area per non-spherical magnetic particle A is larger than that of an almost spherical particle, there is an added advantage of an increase in the strength achieved through an increased adhesion to the resin C.

Figure 2:
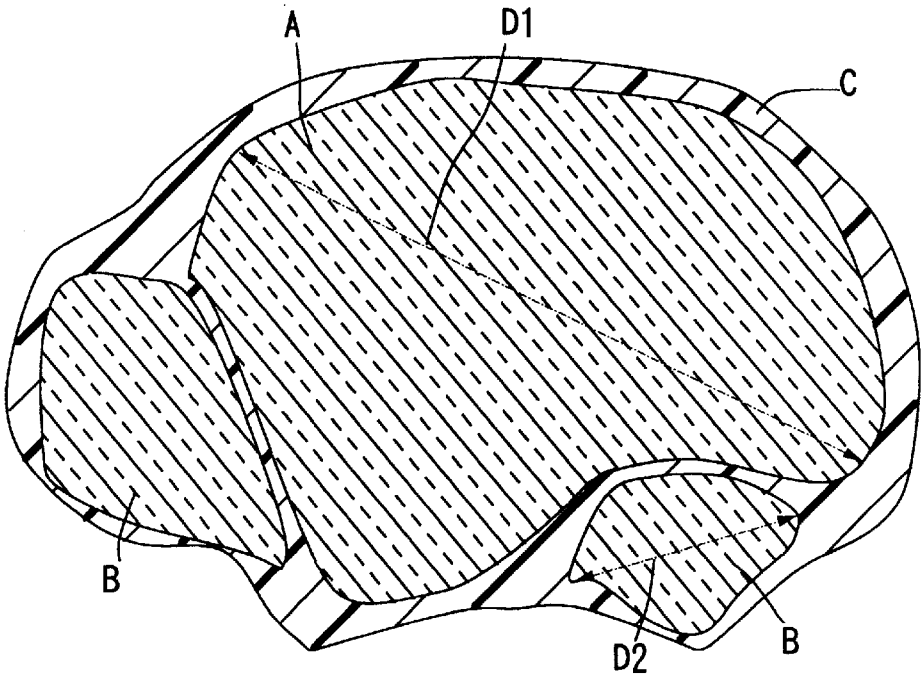
FIG. 2 is an enlarged cross section illustrating another example of a resin-coated magnetic particle contained in the magnetic powder according to the present invention.

Next, in FIG. 2, the combined resin-coated magnetic particles are constituted of a first magnetic particle A having a particle diameter D1 and second magnetic particles B having a particle diameter D2, with the first magnetic particle A and the second magnetic particles B commonly coated by resin C. Both the first magnetic particle A having the particle diameter D1 and the second magnetic particles B having the particle diameter D2 are formed in a non-spherical shape. The particle diameter D2 of the second magnetic particles B is much smaller than the particle diameter D1 of the first magnetic particle A. The particle diameters D1 and D2 of the first magnetic particle A and the second magnetic particles B are defined as the maximum diameters of the individual particles. It is desirable to set the maximum and minimum particle diameters of the first magnetic particle A at 5000 μm and 355 μm respectively. It is desirable to set the particle diameter D2 of the second magnetic particles B at less than 355 μm if the particle diameter D1 of the first magnetic particle A is set as described above.

When a magnetic molded article is formed using a magnetic powder constituted of resin-coated magnetic particles such as illustrated in FIG. 2, the gaps formed between the first magnetic particles A having the large particle diameter D1 are filled with second magnetic particles B having the small particle diameter D2, thereby further increasing the weight of the magnetic particles A and B relative to the entire volume of the resin-coated magnetic particles to assure even more improved electromagnetic characteristics.

In addition, since the gaps formed between the first magnetic particles A having the large particle diameter D1 are filled with the second magnetic particles B having the small particle diameter D2, the quantity of the resin C present between the magnetic particles can be reduced to lower its magnetic resistance. As a result, the electromagnetic characteristics can be further improved.

Through a synergy of the advantages described above, it is possible to obtain a magnetic molded article that achieves an initial magnetic permeability of 40 or more compared to the initial magnetic permeability in the 30's achieved in the prior art through the magnetic powder according to the present invention.

While both the first magnetic particle A and the second magnetic particles B are formed in non-spherical shapes in FIG. 2, it is only required that at least either the first magnetic particles A or the second magnetic particles B be non-spherical. In other words, the first magnetic particles A may be formed in a spherical shape with the second magnetic particles B formed in non-spherical shapes, or the first magnetic particles A may be formed in non-spherical shapes with the second magnetic particles B formed in a spherical shape.

In the actual magnetic powder, the resin-coated magnetic particles such as illustrated in FIG. 1, and the magnetic particles such as illustrated in FIG. 2 are provided together. The number of magnetic particles contained in the resin-coated magnetic particle shown in FIG. 2, i.e., the ratio of the first magnetic particles A and the second magnetic particles B, is not necessarily restricted to that illustrated in the figure.

The initial magnetic permeability of a magnetic molded article is determined in relation to the initial magnetic permeabilities of the magnetic particles A and B. It is desirable to use magnetic particles A and B having initial magnetic permeabilities of 200 or more.

Since the advantages of the present invention are achieved by forming magnetic particles in non-spherical shapes, they can be achieved in the same manner even with different types of magnetic particles. In other words, the magnetic particles according to the present invention may be constituted of either a magnetic oxide material or a metallic magnetic material. A typical example of a magnetic oxide material is ferrite, which includes Mn group soft ferrites, Mg group soft ferrites and Ni group soft ferrites. These magnetic ferrite materials may contain various additives.

Furthermore, a magnetic oxide material or a metallic magnetic material may be employed by itself to constitute the resin-coated magnetic particles, or a magnetic particle constituted of a plurality of magnetic materials selected from the magnetic materials listed above may be contained within one resin-coated magnetic particle.

An Mn soft ferrite, an Mg soft ferrite, an Ni soft ferrite or the like may be employed by itself to constitute the resin-coated magnetic particles or a magnetic particle constituted of a plurality of magnetic materials selected from the ferrite materials listed above may be contained within a single resin-coated magnetic particle.

The magnetic powder according to the present invention may contain either resin-coated magnetic particles constituted by employing one of the various magnetic materials listed above or resin-coated magnetic particles which include magnetic particles each constituted of a plurality of magnetic materials selected from the magnetic materials listed above, or the magnetic powder according to the present invention may contain both of them.

Next, an explanation is given in more specific terms in reference to test examples.

TEST EXAMPLE 1

Ferrite powder achieved by pulverizing an Mn soft ferrite was classified into 5 different particle size distributions particle diameters of 1000 μm or more;

particle diameters less than 1000 μm and equal to or more than 425 μm;

particle diameters less than 425 μm and equal to or more than 300 μm;

particle diameters less than 300 μm and equal to or more than 125 μm; and particle diameters less than 125 μm.

Of the ferrite powders having the various particle size distributions achieved through this classification, the powders that belong in a particle size distribution of 355 μm or more constitute a group of first magnetic particles A, whereas the ferrite powders that belong in a particle size distribution of less than 355 μm constitute a group of second magnetic particles B. The maximum particle diameter of the magnetic particles included in the group of first magnetic particles A is approximately 5000 μm.

Since the group of first magnetic particles A and the group of second magnetic particles B are both constituted of the ferrite powder achieved through pulverization, they are formed in non-spherical shapes (amorphous shapes).

Next, the group of first magnetic particles A, 50 wt % or more of which has a particle size distribution within the range of 425 μm to 1000 μm and the group of second magnetic particles B, 50 wt % or more of which has a particle size distribution within the range of 125 μm to 300 μm was mixed at a mixing ratio (weight ratio) A:B of 6:4.

This mixed ferrite powder was then placed within a grinding mill and agitated for approximately 3 minutes with a styrene acrylic resin powder added. Thus, a magnetic powder achieved by coating the mixed ferrite powder with the styrene 25 acrylic resin was obtained. The ratio at which the mixed ferrite powder and the styrene acrylic resin was mixed was 10:1 in weight ratio. With this, a magnetic powder containing the resin-coated magnetic particles such as illustrated in FIG. 2 was achieved.

Next, the magnetic powder thus achieved was placed in a metal mold and was heated to a temperature of 140° C. while applying pressure at 1 (t/cm$^2$) to produce a toroidal core, and its electromagnetic characteristics were measured.

For purposes of comparison, after obtaining magnetic particles constituted of spherical Mn soft ferrite were obtained in conformance to a method in the prior art, they were classified by employing the method described above, the classified magnetic particles were mixed at the same particle size distributions and the same mixing ratio as above and were then coated with styrene acrylic resin through a process similar to that described above. Using a magnetic powder containing the resin-coated magnetic particles thus obtained, a toroidal core was produced in a manner identical to that described above and its electromagnetic characteristics were measured.

Table I presents the moldability, the electromagnetic characteristics and the volume weight indices achieved by the toroidal cores thus obtained. In Table I, the volume weight index refers to the value calculated through the following formula when the volume of the toroidal core is expressed as V (cc) and the weight of the ferrite within it is expressed as W (g).

Volume weight index=W/V

The volume V (cc) of the toroidal core represents the total volume of the group of first magnetic particles A, the group of second magnetic particles B and the styrene acrylic resin, and the weight W (g) of the ferrite filling represents the weight of the mixture constituted of the group of first magnetic particles A and the group of second magnetic particles B.

TABLE I

| No. | magnetic particle shape | Resin content ratio Ferrite: resin | moldability | Initial magnetic permeability (1 kHz) | Volume weight index (g/cc) |
|---|---|---|---|---|---|
| 11 | Non-spherical | 10:1 | good | 40 | 3.31 |
| 12 | Spherical | 10:1 | good | 35 | 3.15 |

Thermosetting resin powder (epoxy resin):
Product name; Ararudite AT-1, manufactured by Ciba Geigy In Table I, the volume weight index in test piece No. 12 (example for comparison) achieved by coating the spherical magnetic particles constituted of an Mn soft ferrite, with the resin being low, at 3.15, and consequently, a sufficient degree of magnetic particle filling could not be achieved, resulting in a low initial magnetic permeability of 35. In contrast, the volume weight index in test piece No. 11 achieved by coating non-spherical magnetic particles constituted of pulverized pieces of an Mn soft ferrite with the resin being high, at 3.31, achieving an initial magnetic permeability of 40 and demonstrating a significant improvement in the electromagnetic characteristics over test piece No. 12.

The electromagnetic characteristics, the moldability and the like of a magnetic molded article constituted of the magnetic powder according to the present invention can be controlled at desirable values by controlling the particle size distribution of the magnetic particles that are to be included in the resin-coated magnetic particles, the mixing ratio at which a plurality of types of magnetic particles having different particle diameters are mixed, the mixing ratio at which the magnetic particles and the resin are mixed, the initial magnetic permeability of the magnetic particles and the like. Examples of control of these factors are explained below in reference to test examples.

TEST EXAMPLE 2

Particle Size Distribution

The mixing ratios (weight ratios) in the group of first magnetic particles A and the group of second magnetic particles B obtained through a classification process similar to that employed in test example 1 were varied within the particle size distribution ranges given in reference to test example 1. Both the group of first magnetic particles A and the group of second magnetic particles B are constituted of pulverized pieces of Mn soft ferrite, and are non-spherical. The group of first magnetic particles A and the group of second magnetic particles B were mixed at a mixing ratio (weight ratio) A:B of 6:4. This mixed ferrite powder was then placed in a grinding mill and agitated for approximately 3 minutes with a styrene acrylic resin powder added. Thus, a magnetic powder achieved by coating the mixed ferrite powder with the styrene acrylic resin was obtained. The mixed ferrite powder and the styrene acrylic resin were mixed at a weight ratio of 10:1.

Next, using the magnetic powders thus obtained, toroidal cores were produced through a molding process similar to that employed in test example 1 and their electromagnetic characteristics were measured.

Table II presents particle size distributions, mixing ratios, moldability, electromagnetic characteristics and volume weight indices of core test pieces Nos. 21 to 28 thus obtained.

TABLE II

| No. | Particle size distribution of magnetic particles A (μm) 1000 or more (wt. %) | 1000~425 (wt. %) | 425 or less (wt. %) | Particle size distribution of magnetic particles B (μm) 300 or more (wt. %) | 300~125 (wt. %) | 125 or less (wt. %) | mixing ratio A:B | Resin content ratio ferrite: resin | moldability | Initial magnetic permeability (1 kHz) | volume weight index (g/cc) |
|---|---|---|---|---|---|---|---|---|---|---|---|
| 21 | 40 | 60 | 0 | 0 | 50 | 50 | 60:40 | 10:1 | good | 42 | 3.33 |
| 22 | 50 | 50 | 0 | 0 | 50 | 50 | 60:40 | 10:1 | good | 40 | 3.31 |
| 23 | 60 | 40 | 0 | 0 | 50 | 50 | 60:40 | 10:1 | bad | 39 | 3.27 |
| 24 | 50 | 50 | 0 | 0 | 60 | 40 | 60:40 | 10:1 | good | 42 | 3.34 |
| 25 | 50 | 50 | 0 | 0 | 40 | 60 | 60:40 | 10:1 | not good | 39 | 3.27 |

TABLE II-continued

| No. | Particle size distribution of magnetic particles A (μm) 1000 or more (wt. %) | 1000~425 (wt. %) | 425 or less (wt. %) | Particle size distribution of magnetic particles B (μm) 300 or more (wt. %) | 300~125 (wt. %) | 125 or less (wt. %) | mixing ratio A:B | Resin content ratio ferrite: resin | moldability | Initial magnetic permeability (1 kHz) | volume weight index (g/cc) |
|---|---|---|---|---|---|---|---|---|---|---|---|
| 26 | 0 | 50 | 50 | 50 | 50 | 0 | 60:40 | 10:1 | good | 47 | 3.49 |
| 27 | 0 | 50 | 50 | 0 | 50 | 50 | 60:40 | 10:1 | good | 40 | 3.30 |
| 28 | 50 | 50 | 0 | 50 | 50 | 0 | 60:40 | 10:1 | good | 53 | 3.66 |

As indicated in Table II, initial magnetic permeabilities of 40 or more as well as outstanding moldability are achieved in test Pieces Nos. 21, 22, 24 and 26 to 28, in all of which, 50 wt % or more of the group of first magnetic particles A have a particle size distribution within the range of 425 μm or more and less than 1000 μm and 50 wt % or more of the group of second magnetic particles B have a particle size distribution within the range of 125 μm or more and less than 300 μm.

In contrast, with the test piece No. 23, in which 50 wt % or more of the group of first magnetic particles A have a particle diameter of 1000 μm or more, the moldability tends to be inferior compared to that in the other test pieces, whereas in the case of the test piece No. 25, in which 50 wt % or more of the group of second magnetic particles B have a particle diameter of 125 μm or less, the electromagnetic characteristics tend to be inferior compared to those achieved by the other test pieces.

Consequently, 50 wt % or more of the group of first magnetic particles A should have a particle size distribution within the range of 425 μm or more, and less than 100 μm and that 50 wt % or more of the group of second magnetic particles B should have a particle size distribution within the range of 125 μm or more and less than 300 μm.

In addition, it is learned from Table II that the optimal mixing ratio of the mixed ferrite powder and the resin is within the range over which the volume weight index is at 3.3 or more.

TEST EXAMPLE 3

Mixing ratio of the group of first magnetic particles A and the group of second magnetic particles B.

The group of first magnetic particles A and the group of second magnetic particles B were obtained through a method identical to that employed in test example 1. An adjustment was made on the group of first magnetic particles A so that 97 wt % of the group of first magnetic particles A would have a particle size distribution of 425 μm or more and less than 1000 μm while achieving an average particle diameter of approximately 600 μm. In addition, an adjustment was made on the group of second magnetic particles B so that 97 wt % of the group of second magnetic particles B would have a particle size distribution of 125 μm or more and less than 300 μm while achieving an average particle diameter of approximately 180 μm. The group of first magnetic particles A and the group of second magnetic particles B were mixed, toroidal cores were produced through a method similar to that employed in test example 1 and their electromagnetic characteristics were measured.

Table III presents the particle size distributions in the group of first magnetic particles A and the group of second magnetic particles B, the mixing ratios, the resin content ratios, the moldability, the initial magnetic permeabilities and the volume weight indices of test pieces Nos. 31 to 39 thus obtained.

TABLE III

| No. | Particle size distribution of magnetic particles A (μm) 1000 or more (wt. %) | 1000~425 (wt. %) | 425 or less (wt. %) | Particle size distribution of magnetic particles B (μm) 300 or more (wt. %) | 300~125 (wt. %) | 125 or less (wt. %) | mixing ratio A:B | Resin content ratio ferrite: resin | moldability | Initial magnetic permeability (1 kHz) | volume weight index (g/cc) |
|---|---|---|---|---|---|---|---|---|---|---|---|
| 31 | 1.5 | 97 | 1.5 | 1.5 | 97 | 1.5 | 40:60 | 10:1 | good | 49 | 3.55 |
| 32 | 1.5 | 97 | 1.5 | 1.5 | 97 | 1.5 | 50:50 | 10:1 | good | 54 | 3.69 |
| 33 | 1.5 | 97 | 1.5 | 1.5 | 97 | 1.5 | 60:40 | 10:1 | good | 53 | 3.67 |
| 34 | 1.5 | 97 | 1.5 | 1.5 | 97 | 1.5 | 70:30 | 10:1 | good | 49 | 3.57 |
| 35 | 1.5 | 97 | 1.5 | 1.5 | 97 | 1.5 | 80:20 | 10:1 | good | 42 | 3.35 |
| 36 | 1.5 | 97 | 1.5 | 1.5 | 97 | 1.5 | 90:10 | 10:1 | good | 45 | 3.45 |
| 37 | 1.5 | 97 | 1.5 | 1.5 | 97 | 1.5 | 95:5 | 10:1 | good | 49 | 3.55 |
| 38 | 1.5 | 97 | 1.5 | 1.5 | 97 | 1.5 | 99:1 | 10:1 | good | 53 | 3.66 |
| 39 | 1.5 | 97 | 1.5 | 1.5 | 97 | 1.5 | 100:0 | 10:1 | bad | 37 | 3.21 |

By referring to table III, it is learned that test pieces Nos. 31 to 38 that satisfy $99 \geqq A \geqq 40$ or $60 \geqq B \geqq 1$ on a premise that A+B=100 with A representing the weight of the group of first magnetic particles A, and B representing the weight of the group of second magnetic particles B achieve good electromagnetic characteristics and superior moldability. In the case of test piece No. 39 which does not fall into either of the ranges above with A=100 and B=0, both the moldability and the initial magnetic permeability are inferior. Thus, it is concluded that it is desirable to mix the group of first magnetic particles A and the group of second magnetic particles B.

TEST EXAMPLE 4

Resin Content Ratio

The group of first magnetic particles A and the group of second magnetic particles B were obtained through a method similar to that employed in test example 1. An adjustment was made on the group of first magnetic particles A so that 97 wt % of the group of first magnetic particles A would have a particle size distribution of 425 μm or more and less than 1000 μm while achieving an average particle diameter of approximately 600 μm. 1.5 wt % of the group of first magnetic particles A had a particle size distribution of 1000 μm or more and the remaining 1.5 wt % had a particle size distribution of less than 425 μm. An adjustment was made on the group of second magnetic particles B so that 97 wt % of the group of second magnetic particles B thus obtained would have a particle size distribution of 125 μm or more and less than 300 μm while achieving an average particle diameter of approximately 180 μm. 1.5 wt % of the group of second magnetic particles B had a particle size distribution of 300 μm or more and less than 425 μm and the remaining 1.5 wt % had a particle size distribution of less than 125 μm.

Styrene acrylic resin coating was implemented on the group of first magnetic particles A and the group of second magnetic particles B through a method similar to that employed in test example 1. The styrene acrylic resin was added by varying the resin content ratio (weight ratio) relative to the first powder A and the second powder B.

Next, toroidal cores were produced through a process similar to that employed in test example 1, and their electromagnetic characteristics were measured.

Table IV presents the particle size distributions in the group of first magnetic particles A and the group of second magnetic particles B, the mixing ratios, the resin content ratios, the moldability, the initial magnetic permeabilities and the volume weight indices of test pieces Nos. 41 to 48 thus obtained. In table IV, the resin content ratios relative to the first powder A and the second powder B are presented under "ferrite:resin."

TABLE IV

| | Particle size distribution of magnetic particles A (μm) | | | Particle size distribution of magnetic particles B (μm) | | | | Resin content | | Initial | volume |
|---|---|---|---|---|---|---|---|---|---|---|---|
| No. | 1000 or more (wt. %) | 1000~425 (wt. %) | 425 or less (wt. %) | 300 or more (wt. %) | 300~125 (wt. %) | 125 or less (wt. %) | mixing ratio A:B | ratio ferrite: resin | moldability | magnetic permeability (1 kHz) | weight index (g/cc) |
| 31 | 1.5 | 97 | 1.5 | 1.5 | 97 | 1.5 | 60:40 | 10:0.10 | bad | 38 | 3.25 |
| 42 | 1.5 | 97 | 1.5 | 1.5 | 97 | 1.5 | 60:40 | 10:0.25 | not good | 50 | 3.58 |
| 43 | 1.5 | 97 | 1.5 | 1.5 | 97 | 1.5 | 60:40 | 10:0.50 | good | 54 | 3.71 |
| 44 | 1.5 | 97 | 1.5 | 1.5 | 97 | 1.5 | 60:40 | 10:0.75 | good | 54 | 3.68 |
| 45 | 1.5 | 97 | 1.5 | 1.5 | 97 | 1.5 | 60:40 | 10:1 | good | 53 | 3.65 |
| 46 | 1.5 | 97 | 1.5 | 1.5 | 97 | 1.5 | 60:40 | 10:2 | good | 45 | 3.46 |
| 47 | 1.5 | 97 | 1.5 | 1.5 | 97 | 1.5 | 60:40 | 10:2.5 | good | 40 | 3.31 |
| 48 | 1.5 | 97 | 1.5 | 1.5 | 97 | 1.5 | 60:40 | 10:3 | good | 35 | 3.15 |

In Table IV, test piece No. 31 in which the styrene acrylic resin is mixed at a resin content ratio (ferrite : resin) of 10:0.10 relative to the group of first magnetic particles A and the group of second magnetic particles B demonstrates inferior moldability and a low initial magnetic permeability (1 kHz) of 38. In the case of test piece No. 32 achieved at a resin content ratio (ferrite : resin) of 10:0.25, while it demonstrates superior initial magnetic permeability, its moldability is inferior.

In contrast, test cases Nos. 43 to 48 that satisfy a resin content ratio range of (ferrite: resin)=(10:0.5) to (10:3) achieve both superior moldability and good initial magnetic permeability (1 kHz).

Thus, it is concluded that the resin content ratio (ferrite:resin) of the styrene acrylic resin relative to the group of first magnetic particles A and the group of second magnetic particles B should be within the range within which test pieces Nos. 43 to 48 were produced.

TEST EXAMPLE 5

Resin

The same particle size distributions and the same mixing ratio of the group of first magnetic particles A and the group of second magnetic particles B as those in test example 1 were used, and a thermosetting resin and a thermoplastic resin were employed to coat the powder to examine changes in the characteristics caused by the use of different resins. The powder employing the thermosetting resin was molded at the temperature at which the resin sets. The results of the test are shown in Table V.

TABLE V

| No. | Resin type | Resin content ratio Ferrite: resin | moldability | Initial magnetic permeability (1 kHz) | Volume weight index (g/cc) |
|---|---|---|---|---|---|
| 51 | Thermosetting resin powder (epoxy resin) | 10:1 | good | 40 | 3.31 |
| 52 | styrene acrylic resin (powder) | 10:1 | good | 53 | 3.66 |

Thermosetting resin powder (epoxy resin):
Product name; Ararudite AT-1, manufactured by Ciba Geigy As the results in Table V indicate, moldability and electromagnetic characteristics that are almost equivalent to those achieved when a thermoplastic resin is used are assured when a thermosetting resin is used.

TEST EXAMPLE 6

Initial Magnetic Permeabilities of First Magnetic Particles A and Second Magnetic Particles B.

By using the first magnetic particles A and the second magnetic particles B (both constituted of Mn soft ferrite) at varying initial magnetic permeabilities $\mu i$, the relationship between the initial magnetic permeability $\mu i$ of the magnetic particles and the magnetic permeability of a magnetic molded article was examined.

An adjustment was made on the group of first magnetic particles A so that 97 wt % of the group of first magnetic particles A would have a particle size distribution of 425 μm or more and less than 1000 μm while achieving an average particle diameter of approximately 600 μm. 1.5 wt % of the group of first magnetic particles A had a particle size distribution of 1000 μm or more and the remaining 1.5 wt % had a particle size distribution of less than 425 μm.

An adjustment was made on the group of second magnetic particles B so that 97 wt % of the group of second magnetic particles B would have a particle size distribution of 125 μm or more and less than 300 μm while achieving an average particle diameter of approximately 180 μm. 1.5 wt % of the group of second magnetic particles B had a particle size distribution of 300 μm or more and less than 425 μm and the remaining 1.5 wt % had a particle size distribution of less than 125 μm.

The group of first magnetic particles A and the group of second magnetic particles B were mixed at a weight ratio of A:B of 6:4 and the mixture was then placed in a grinding mill. It was then agitated for approximately 3 minutes with styrene acrylic resin powder added for coating. The styrene acrylic resin was added to achieve different resin content ratios (weight ratios) relative to the group of first magnetic particles A and the group of second magnetic particles B.

Next, toroidal cores were produced through a process similar to that employed in test example 1 and their initial magnetic permeabilities were measured. Table VI presents the relationships between the initial magnetic permeabilities μi of the magnetic particles and the initial magnetic permeability of the magnetic molded article measured for test pieces Nos. 61 to 64 which were obtained by varying the initial magnetic permeability μi.

TABLE VI

| Test piece No. | μi of magnetic particles A and B | Initial magnetic permeability of magnetic molded article |
|---|---|---|
| 61 | 50 | 5 |
| 62 | 200 | 43 |
| 63 | 500 | 45 |
| 64 | 2000 | 50 |

Table VI indicates that by using the first magnetic particles A and the second magnetic particles B having an initial magnetic permeability μi of 200 or more, a magnetic molded article having an initial magnetic permeability of 43 or more can be achieved.

While the invention has been particularly shown and described with respect to preferred embodiments thereof by referring to the attached drawings, the present invention is not limited to these examples and it will be understood by those skilled in the art that various changes in form and detail may be made therein without departing from the spirit, scope and teaching of the invention.

INDUSTRIAL APPLICABILITY

As has been explained, according to the present invention, a magnetic powder through which electromagnetic characteristics may be improved by increasing the filling quantity of magnetic particles when it is employed to constitute a magnetic molded article, and a magnetic molded article constituted by molding this magnetic powder are provided.

What is claimed is:

1. A magnetic powder constituted of an aggregation of resin-coated magnetic particles, wherein;

said resin-coated magnetic particles include a plurality of types of magnetic particles having different particle diameters, with said plurality of types of magnetic particles commonly coated with a resin, and said resin-coated magnetic particles include non-spherical magnetic particles coated with said resin.

2. A magnetic powder according to claim 1, wherein:

at least one of said plurality of types of magnetic particles is formed in a non-spherical shape and at least one of said plurality of types of magnetic particles is formed in a spherical shape.

3. A magnetic powder according to claim 2, wherein:

among said plurality of types of magnetic particles, magnetic particles having a largest particle diameter are formed in a non-spherical shape.

4. A magnetic powder according to claim 2, wherein among said plurality of types of magnetic particles, magnetic particles having a largest particle diameter are formed in a spherical shape.

5. A magnetic powder according to claim 1, wherein the largest particle diameter in said magnetic particles is 5000 μm.

6. A magnetic powder according to claim 1, wherein:

said magnetic particles are constituted of ferrite.

7. A magnetic powder according to claim 1, wherein:

said magnetic particles are constituted of a metallic material.

8. A magnetic powder according to claim 1, wherein:

said plurality of types of magnetic particles included in said resin-coated magnetic particles belong in either a group of first magnetic particles or a group of second magnetic particles;

magnetic particles in said group of first magnetic particles have a particle diameter of 355 μm or more and less than 5000 μm, with 50 wt % or more of said group of first magnetic particles having a particle size distribution within a range of 425 μm or more and less than 1000 μm; and magnetic particles in said group of second magnetic particles have a particle diameter of less than 355 μm, with 50 wt % or more of said group of second magnetic particles belonging in a particle size distribution within a range of 125 μm or more and less than 300 μm.

9. A magnetic powder according to claim 8, wherein:

when the weight of said group of first magnetic particles is represented by A and the weight of said group of second magnetic particles is represented by B, $99 \geqq A \geqq 40$ or $60 \geqq B \geqq 1$ is satisfied on a premise that $A+B=100$.

10. A magnetic powder according to claim 1, wherein:

said magnetic particles have an initial magnetic permeability of 200 or more.

11. A magnetic molded article obtained by molding the magnetic powder of claim 1.

12. A magnetic molded article according to claim 11, wherein:

at least one of said plurality of types of magnetic particles is formed in a non-spherical shape and at least one of said plurality of types of magnetic particles is formed in a spherical shape.

13. A magnetic molded article according to claim 12, wherein:

among said plurality of types of magnetic particles, magnetic particles having a largest particle diameter are formed in a non-spherical shape.

14. A magnetic molded article according to claim 12, wherein:

among said plurality of types of magnetic particles, magnetic particles having a largest particle diameter are formed in a spherical shape.

15. A magnetic molded article according to claim 11, wherein:

the largest particle diameter in said magnetic particles is 5000 μm.

16. A magnetic molded article according to claim 14, wherein:

said magnetic particles are constituted of ferrite.

17. A magnetic molded article according to claim 11, wherein:

said magnetic particles are constituted of a metallic material.

18. A magnetic molded article according to claim 11, constituted of a group of first magnetic particles and a group of second magnetic particles, wherein:

magnetic particles in said group of first magnetic particles have a particle diameter of 355 μm or more and 5000 μm or less, with 50 wt % or more of said group of first magnetic particles belonging in a particle size distribution within a range of 425 μm or more and less than 1000 μm; and magnetic particles in said group of second magnetic particles have a particle diameter of less than 355 μm, with 50 wt % or more of said group of second magnetic particles belonging in a particle size distribution within a range of 125 μm or more and less than 300 μm.

19. A magnetic molded article according to claim 18, wherein:

when the weight of said group of first magnetic particles is represented by A and the weight of said group of second magnetic particles is represented by B, $99 \geqq A \geqq 40$ or $60 \geqq B \geqq 1$ is satisfied on a premise that $A+B=100$.

20. A magnetic molded article according to claim 19, wherein:

when a total weight of said group of first magnetic particles and said group of second magnetic particles is expressed as W (g) and a total volume of said group of first magnetic particles, said group of second magnetic particles and said resin is expressed as V (cc), $W/V \geqq 3.3$ is satisfied.

21. A magnetic molded article according to claim 11, wherein:

said magnetic particles have an initial magnetic permeability of 200 or more.

22. A core of a choke coil, an inductor, a rotary transformer, or an EMI element comprising the magnetic molded article according to claim 11.

* * * * *